US007749214B2

(12) United States Patent
Hwang et al.

(10) Patent No.: US 7,749,214 B2
(45) Date of Patent: Jul. 6, 2010

(54) DISPOSABLE UNDERGARMENT FOR MEDICAL TREATMENT AND SURGERY

(76) Inventors: Seon-Moon Hwang, Boram maeul Aju Apt., jung 1-dong, Wonmi-gu, Bucheon-si, Gyeonggi-do (KR) 1114-503; Yeun-Joo Park, Boram maeul Aju Apt., Jung 1-dong, Wonmi-gu, Bucheon-si, Gyeonggi-do (KR) 1114-503; Dae-Chul Suh, Hangang Hyundai Apt., Heukseok-dong, Seoul, Dongjak-gu (KR) 106-1403

( * ) Notice: Subject to any disclaimer, the term of this patent is extended or adjusted under 35 U.S.C. 154(b) by 244 days.

(21) Appl. No.: 11/527,314

(22) Filed: Sep. 26, 2006

(65) Prior Publication Data

US 2007/0271670 A1 Nov. 29, 2007

(30) Foreign Application Priority Data

May 29, 2006 (KR) ..... 10-2006-0048080

(51) Int. Cl.
*A61F 13/82* (2006.01)

(52) U.S. Cl. ..... 604/401; 604/387; 128/855; 2/403

(58) Field of Classification Search ..... 604/389, 604/400–402, 387; 2/402–403; 128/854–855
See application file for complete search history.

(56) References Cited

U.S. PATENT DOCUMENTS 1,489,046 A * 4/1924 Thompson ..... 2/114
3,561,440 A * 2/1971 Bayer et al. ..... 128/853
4,072,151 A * 2/1978 Levine ..... 604/387
4,122,552 A * 10/1978 Tedford ..... 2/402
4,145,763 A * 3/1979 Abrams et al. ..... 2/403
4,479,492 A * 10/1984 Singer ..... 128/853
4,484,919 A * 11/1984 Sohn et al. ..... 604/358

(Continued)

FOREIGN PATENT DOCUMENTS

KR 20-2003-0016632 5/2003

(Continued)

OTHER PUBLICATIONS

Machine translation of KR 20-0325065, Korean Intellectual Property Office, Pub. Aug. 2003.*

(Continued)

*Primary Examiner*—Tatyana Zalukaeva
*Assistant Examiner*—Paula L Craig
(74) *Attorney, Agent, or Firm*—Revolution ZP, PLLC

(57) ABSTRACT

A disposable medical support undergarment is provided selectively to cover a groin part and selectively to expose thigh arteries of a patient at angiography operation and detachably attach a portion of the undergarment. The undergarment includes a front center sheet, a back panel and an assistant sheet. The width of the front center sheet is predetermined to cover the groin part of a patient and expose the left and right thigh arteries near the groin part, and the back panel includes a pair of front side sheets and a back sheet integrated with the pair of front side sheets. The side end portion of front center sheet and the side end portion of the front side sheet of the back panel can be detachably attached each other.

5 Claims, 15 Drawing Sheets

U.S. PATENT DOCUMENTS 4,500,316 A * 2/1985 Damico ..... 604/389
4,596,244 A * 6/1986 Jackson ..... 128/855
4,630,320 A * 12/1986 Van Gompel ..... 2/406
4,745,915 A * 5/1988 Enright et al. ..... 128/853
4,753,650 A * 6/1988 Williams ..... 604/389
4,883,481 A * 11/1989 Blanchard ..... 604/385.11
4,982,450 A * 1/1991 D'Huissier ..... 2/402
5,114,419 A * 5/1992 Daniel et al. ..... 604/385.15
5,315,716 A * 5/1994 Baum ..... 2/227
5,347,657 A * 9/1994 Unsell ..... 2/67
5,611,356 A * 3/1997 Rothrum ..... 128/844
5,658,270 A * 8/1997 Lichstein ..... 604/387
5,690,626 A * 11/1997 Suzuki et al. ..... 604/385.25
5,778,890 A * 7/1998 Lofgren et al. ..... 128/849
5,832,535 A * 11/1998 Davis ..... 2/1
5,876,394 A * 3/1999 Rosch et al. ..... 604/393
5,947,998 A * 9/1999 Cartmell et al. ..... 606/213
5,975,082 A * 11/1999 Dowdy ..... 128/849
6,142,983 A * 11/2000 Suprise et al. ..... 604/385.03
6,277,105 B1 * 8/2001 Rynish ..... 604/385.02
6,293,936 B1 * 9/2001 Otsubo ..... 604/396
6,293,937 B2 * 9/2001 Matsushita et al. ..... 604/396
6,338,161 B1 * 1/2002 Ali Muhammad ..... 2/78.1
6,382,212 B1 * 5/2002 Borchard ..... 128/849
6,641,568 B2 * 11/2003 Ashton et al. ..... 604/385.01
D500,131 S * 12/2004 Choice ..... D24/125
6,918,900 B2 * 7/2005 Johnson ..... 604/385.03
D510,791 S * 10/2005 Nathan-Kohan ..... D2/712
7,125,401 B2 * 10/2006 Yoshimasa ..... 604/392
7,297,139 B2 * 11/2007 Price et al. ..... 604/391
7,344,526 B2 * 3/2008 Yang et al. ..... 604/393
2002/0111596 A1 * 8/2002 Fletcher et al. ..... 604/385.03
2002/0151864 A1 * 10/2002 Otsubo et al. ..... 604/385.29
2003/0188753 A1 * 10/2003 Jascomb ..... 128/853
2003/0229329 A1 * 12/2003 Mercier et al. ..... 604/394
2004/0030318 A1 * 2/2004 Karlsson et al. ..... 604/387
2005/0038400 A1 * 2/2005 Poruthoor ..... 604/385.01
2005/0059948 A1 * 3/2005 Murguly ..... 604/387
2005/0059949 A1 * 3/2005 Murguly ..... 604/387
2005/0115570 A1 * 6/2005 Hare et al. ..... 128/854
2005/0131382 A1 * 6/2005 Brud et al. ..... 604/401
2005/0192555 A1 * 9/2005 Thomas ..... 604/402
2005/0279366 A1 * 12/2005 Adragna ..... 128/849
2006/0207609 A1 * 9/2006 Gil et al. ..... 128/849
2008/0210246 A1 * 9/2008 Johansson et al. ..... 128/851

FOREIGN PATENT DOCUMENTS

KR 20-0325065 * 8/2003

OTHER PUBLICATIONS

Human translation of KR20-0325065, Korean Intellectual Property Office, Pub. Aug. 2003.*

* cited by examiner groin part covered with a disposable non-woven fabric

DISPOSABLE UNDERGARMENT FOR MEDICAL TREATMENT AND SURGERY

This application claims priority to Korean Application No. 10-2006-0048080 filed May 29, 2006.

BACKGROUND

1. Technical Field

The present invention relates to a disposable undergarment, and more particularly, to a disposable undergarment that can be medically used in an angiography medical treatment including an angiography test and/or a general surgery using thereof.

2. Related Art

Angiography is generally defined as an angiography test for blood vessels by using X-ray. Further, the angiography is also used in an interventional medical treatment for curing blood vessel-related diseases. The angiography test is defined as a method in which a diagnosis reagent called a contrast material visible under general X-ray is injected into a blood vessel, and a shape of the blood vessel or a state of blood circulation is observed by using X-ray photography or X-ray cinematography. In order to perform the angiography test, a slender tube called a catheter has to be inserted into the patient's blood vessel from outside the body to a blood vessel portion to be tested, and then the contrast material has to be injected therethrough.

Currently, the angiography test is the most widely used standard method among various angiography methods, and can be used to test almost all blood vessels such as blood vessels in the brain, the head and neck region, the heart, the lungs, the liver, the kidneys, the abdominal internal organs, and the limbs. After the angiography test is completed, the interventional treatment may be performed such as embolization for clogging pathological blood vessels or angioplasty for widening or unclogging narrowed or clogged blood vessels.

In general, the catheter is inserted into the blood vessels of the patient (examinee) through a thigh artery (located at a portion indicated by a circle in FIG. 1) around the groin part. To this end, some part of skin of the above indicated portion is cut, and the catheter is inserted into the thigh artery through the cut portion. The angiography test can be performed under the local anesthesia instead of the general anesthesia except for a particular case. In order to prevent infection through the cut portion, the treatment has to be aseptically performed.

FIG. 1 is a photograph showing a method currently performed for a patient undergoing a medical treatment such as an angiography test. Referring to FIG. 1, a healthcare worker first covers the groin part of the patient with a disposable non-woven fabric which is then fixed to the skin by using an adhesive tape or the like. This is not only to protect the private part of the patient from being unnecessarily exposed during the medical treatment, but also to protect the cut portion from infection due to pubic hairs or body fluids. Thereafter, a portion of the body (indicated by a small circle in FIG. 1) to be inserted with the catheter is sterilized, with the groin part of the patient being under the local anesthesia. Subsequently, after this portion is cut, the catheter is inserted through the thigh artery to perform a required medical treatment.

However, while the patient is subjected to the medical treatment, the following problems may occur.

First, the patent may be infected with other germs through the cut portion. This is because a currently used disposable non-woven fabric and adhesive tape are not sufficiently adhesive to the skin, and thus the patent's pubic hairs or the like may not be entirely covered. In particular, adhesive strength of the adhesive tape may decrease when the patient moves under the local anesthesia, or when a liquid antiseptic is used. Therefore, there is more possibility of infection through the cut portion. In order to prevent such infection, there is no way but to restrict motion of the patient. In this case, the patient under the local anesthesia may feel extremely uncomfortable.

Second, use of the disposable non-woven fabric may not satisfactorily protect dignity of the patient. This is because a lower garment of the patient has to be unclothed so as to attach the disposable non-woven fabric, and the healthcare worker who is a third party has to attach the disposable non-woven fabric onto the groin part of the patient. In this situation, the patient undergoing the medical treatment may feel a sense of shame to some great extent. Further, if this process is carried out in an angiography test room, since many healthcare worker are involved in the process, dignity of the patient may be significantly lost. Accordingly, with the currently used medical treatment, the patient may conceive not only the sense of shame but also a dislike on the medical treatment such as the angiography test, and thereby a necessary test and/or surgery may not be timely performed.

Third, the currently used disposable non-woven fabric is poorly waterproofed, and is almost not durable against chemicals. Thus, antiseptic chemicals or blood flowing out during the medical treatment may be permeated into the groin part. This makes the patient feel uncomfortable, which may lead to motion of the patient. Thus, the healthcare worker may be interfered when performing a sophisticated medical treatment.

In order to solve this problem, a contrivance proposed by an applicant for this patent is disclosed in the Official Gazette for Registered Utility Model No. 20-0325065 entitled "a disposable undergarment for an angiography test, a medical treatment, and a surgery". According to the contrivance, the patient can independently wear a disposable undergarment, thereby protecting dignity of the patient. Further, since a front sheet of the undergarment is formed of a waterproof material, and the both side ends of the front sheet are formed of an elastic material, infection via the cut portion can be prevented. In addition, the contrivance has an advantage to minimize discomfort of the patient stemming from antiseptic chemicals or blood.

Meanwhile, the undergarment according to the aforementioned contrivance may be stained caused by the blood and chemicals used during medical treatment. After the medical treatment is completed, the patient may still have to be clothed with the stained undergarment, or the healthcare worker may have to replace it. In the former case, the patient may feel uncomfortable. In addition, foreign materials stained in the undergarment may become a new source of infection. In the latter case, it may be another cause of losing dignity of the patient. Accordingly, there is a need for a disposable undergarment having a new structure capable of solving the above problems.

SUMMARY OF THE INVENTION

The present invention provides a disposable undergarment for a medical treatment and surgery capable of preventing a patient from being infected by germs via a cut portion during surgery and ensuing dignity of patient as much as possible, while an interventional medical treatment using an angiography test or its equivalent general surgery is performed.

The present invention also provides a disposable undergarment for a medical treatment and surgery capable of easily removing only a portion stained due to antiseptic chemicals or blood without having to unclothe the undergarment worn by a patient after medical treatment (e.g., angiography test, surgery, etc) is completed. The present invention also provides a disposable undergarment for a medical treatment and surgery that can be freely used irrespective of the position of thigh artery or a physical feature of a patient.

According to an aspect of the present invention, there is provided a disposable undergarment comprising: a front center sheet; a back panel; a pair of attaching means; and a pair of assistance sheets. In this case, the back panel includes a pair of front side sheets and a back sheet integrated with the pair of front side sheets, and the pair of attaching means are respectively disposed in a side end portion of the front center sheet and a side end portion of the front side sheet, so as to attach and detach the front center sheet and the front side sheet. Further, the pair of assistance sheets are respectively removably attached to a front side end of the front center sheet such that one side end portion thereof overlaps the side end of the front center sheet, and the other side end portion is provided with an adhesive means.

According to another aspect of the present invention, there is provided a disposable undergarment comprising: a front center sheet; a back panel; a pair of attaching means; and an assistance sheet. In this case, the back panel includes a pair of front side sheets and a back sheet integrated with the pair of front side sheets, and the pair of attaching means are respectively disposed in a side end portion of the front center sheet and a side end portion of the front side sheet, so as to attach and detach the front center sheet and the front side sheet. Further, the assistance sheet is composed of a fixing portion removably fixed to the center of the back sheet, and an assistance portion having a specific width and height so as to expose a thigh artery of the patient and to cover the groin part of the patient, and includes an adhesive means at the upper end and the both side ends of the assistance portion.

According to another aspect of the present invention, there is provided a disposable undergarment comprising: a front sheet; a back sheet; and a covering sheet. In this case, the front sheet includes a pair of holes having a specific size suitable for exposing a position where a thigh artery of the patient are located; a back sheet integrated with the front sheet, and an adhesive means is formed at the rear surface of the front sheet with a specific width along the outer circumference of the hole, and of which the upper surface is attached with a removable cover film. Further, the back sheet is integrated with the front sheet, and the covering sheet entirely covers the holes, and is removably attached to the front surface of the front sheet.

BRIEF DESCRIPTION OF THE DRAWINGS

The above and other features and advantages of the present invention will become more apparent by describing in detail exemplary embodiments thereof with reference to the attached drawings in which.

DESCRIPTION OF EXEMPLARY EMBODIMENTS

Figure 1:
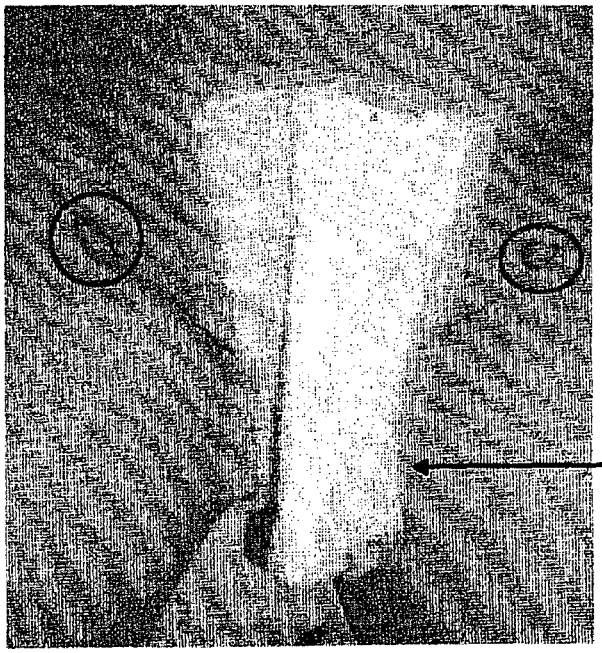
FIG. 1 (BACKGROUND ART)
FIG. 1 is a photograph showing a method currently performed for a patient undergoing a medical treatment such as an angiography test.

Hereinafter, exemplary embodiments of the present invention will be described with reference to the attached drawings. However, the present invention is not limited to the exemplary embodiments, but various modifications may be made therein. In the drawings, the sizes of elements are exaggerated for clarity. Like reference numerals denote like elements throughout the specification.

First Embodiment

Figure 2A:
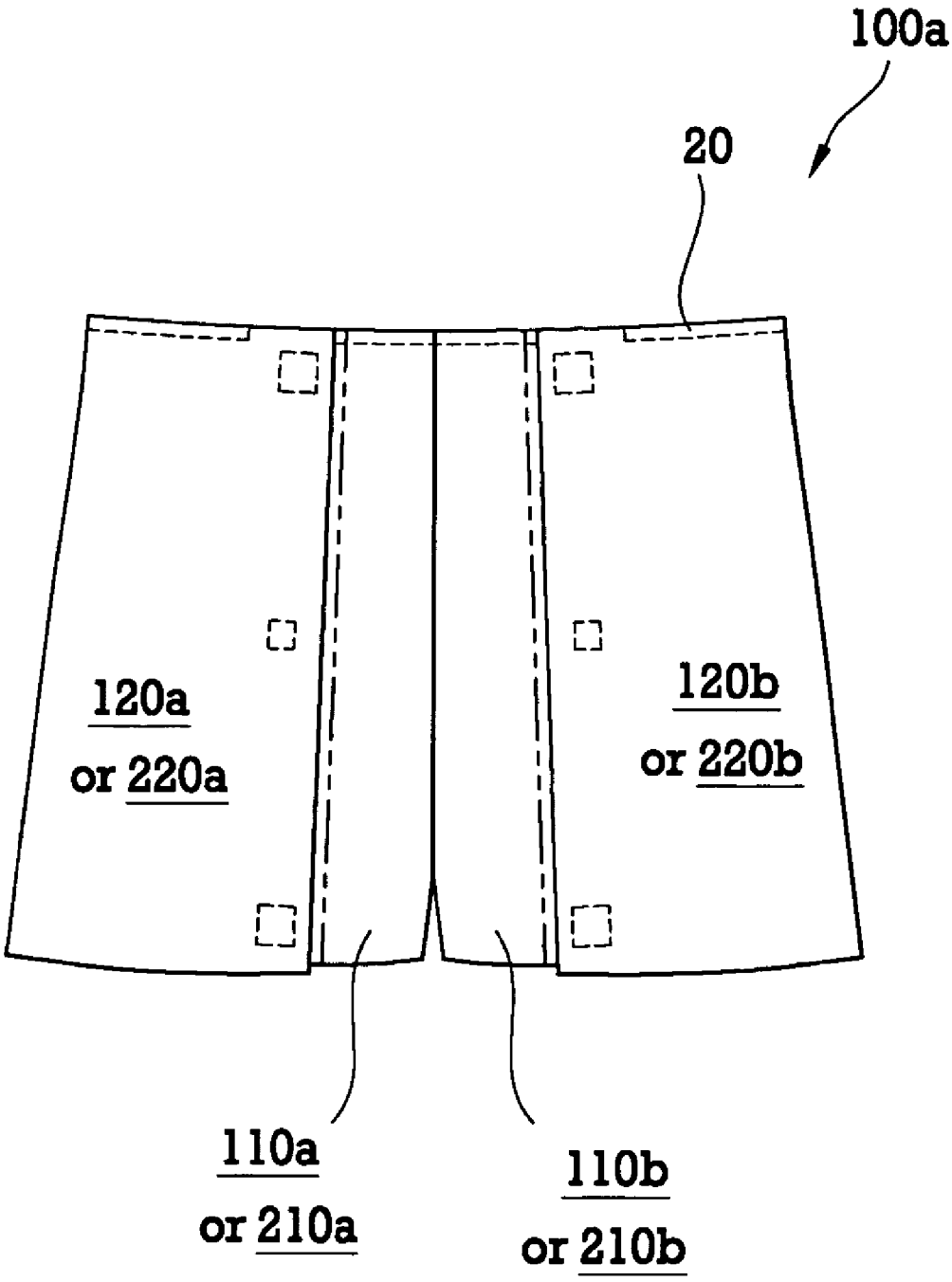
FIG. 2A is a front view of a disposable undergarment for a medical treatment and surgery according to first and second embodiments of the present invention.
Figure 2B:
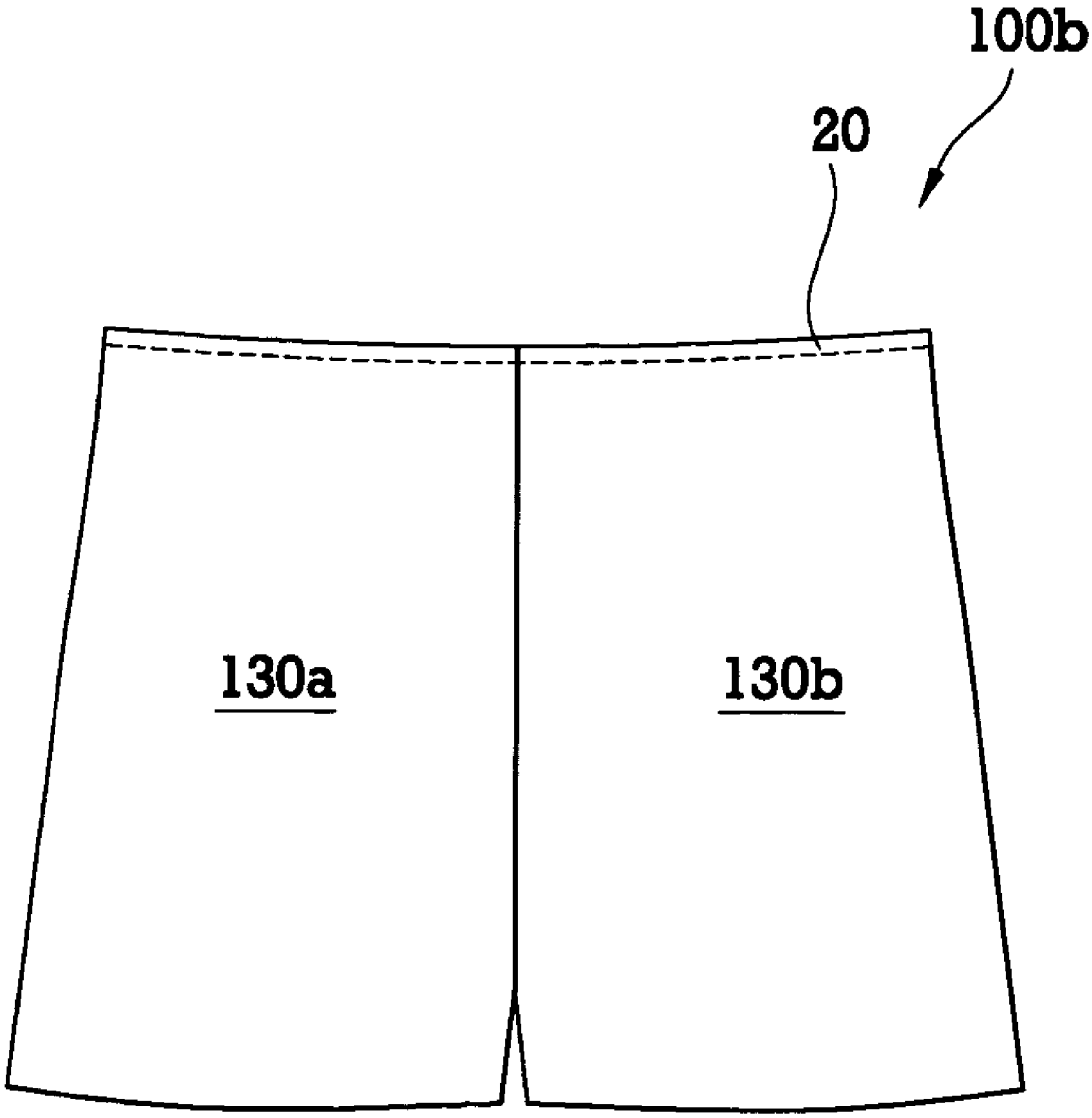
FIG. 2B is a rear view of a disposable undergarment for a medical treatment and surgery according to first and second embodiments of the present invention.
Figure 3A:
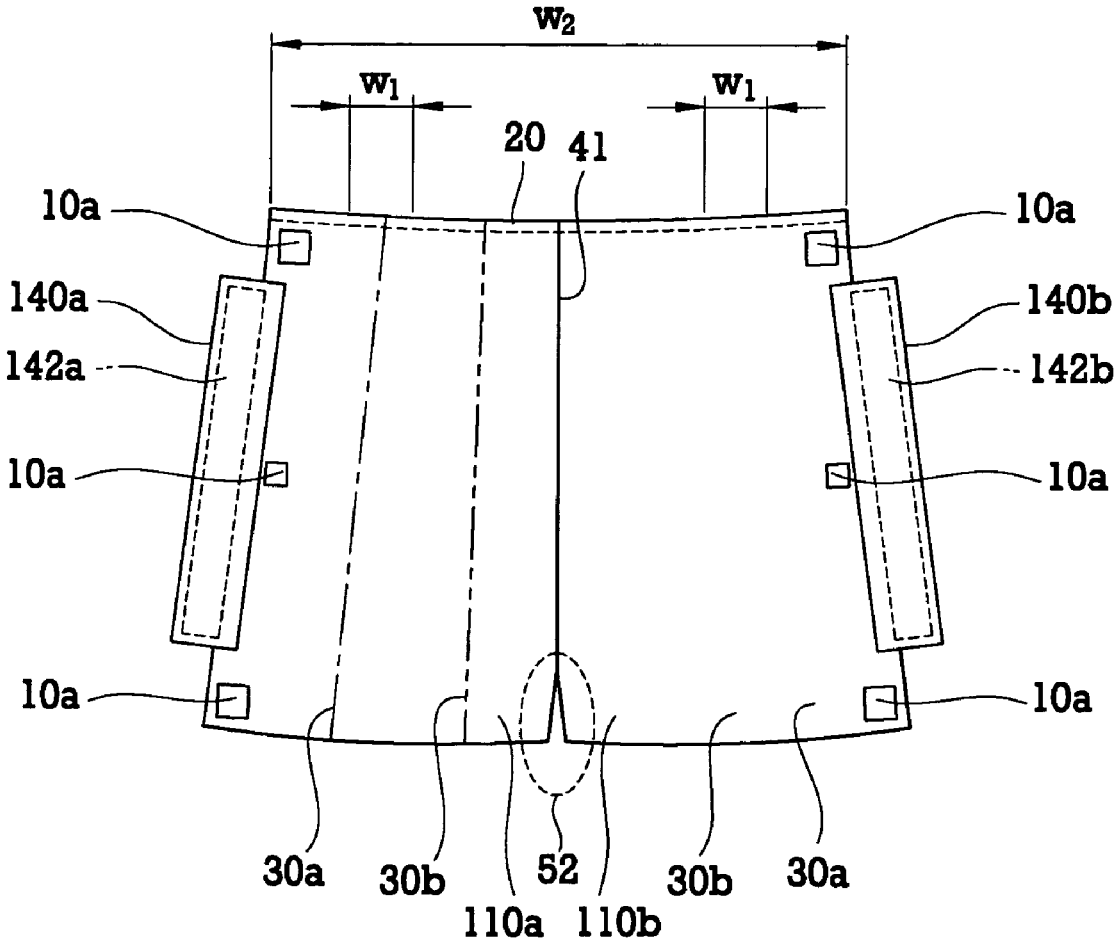
FIG. 3A is a front plan view of front center sheets of a disposable undergarment according to a first embodiment of the present invention.
Figure 3B:
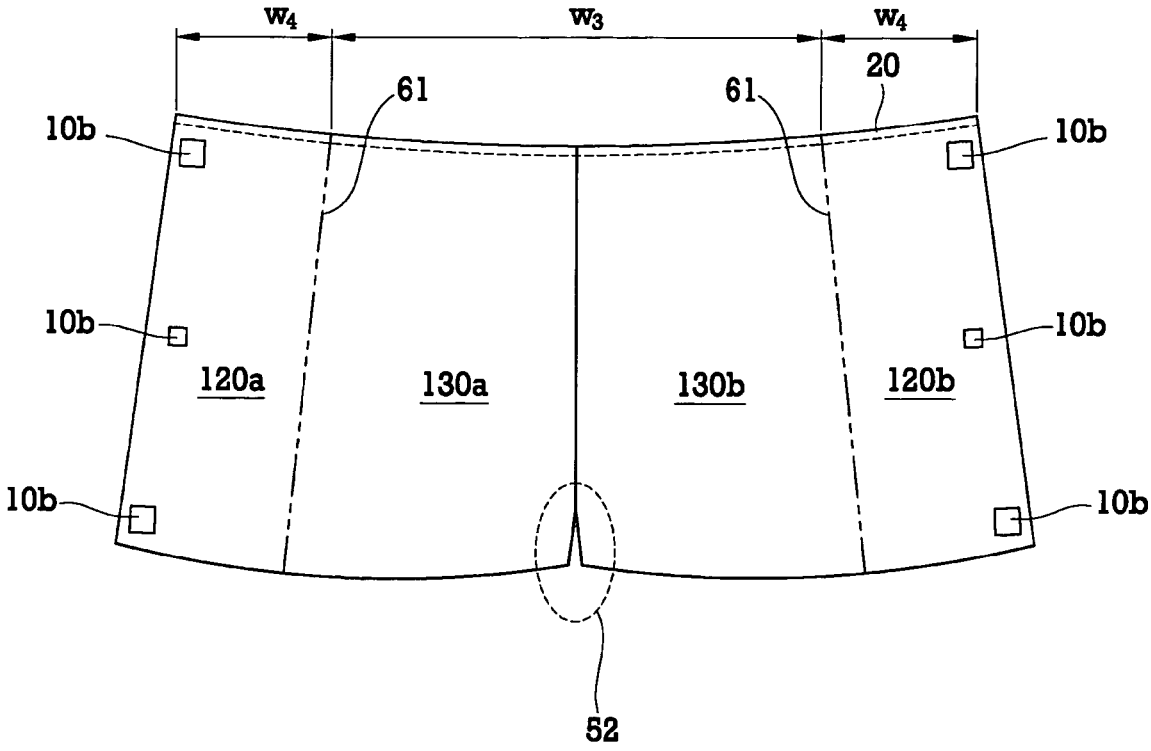
FIG. 3B is plan view showing an inner side of a back panel of a disposable undergarment according to a first embodiment of the present invention.

FIGS. 2A and 2B are a front view and a rear view, respectively, showing a disposable undergarment for a medical treatment and surgery according to a first embodiment of the present invention. FIG. 3A is a front plan view schematically showing front center sheets 110*a* and 110*b* of the disposable undergarment. FIG. 3B is plan view schematically showing a back panel of the disposable undergarment.

Referring to FIGS. 2A, 2B, 3A, and 3B, the disposable undergarment is generally formed in the shape of a boxer shorts, a short pants, or a trunks. Further, the disposable undergarment includes the front center sheets 110*a* and 110*b*, the back panel, a pair of attaching means 10*a* and 10*b*, and a pair of assistance sheets 140*a* and 140*b*. The back panel includes a pair of back sheets 130*a* and 130*b* and a pair of front side sheets 120*a* and 120*b* connected to the both side ends of the back sheets 130*a* and 130*b*. The front center sheets 110*a* and 110*b* and the back sheets 130*a* and 130*b* are respectively connected with each other at a lower end midpoint 52, thereby forming a disposable undergarment in the form of trunks (a boxer shorts shape) as shown in FIGS. 2A and 2B. More specifically, the front center sheets 110*a* and 110*b* and the front side sheets 120*a* and 120*b* constitute a front portion 100*a* of the disposable undergarment, and the back sheets 130*a* and 130*b* constitute a back portion 100*b* thereof.

An upper end 20 of the disposable undergarment is provided with a fixing means for fixing the disposable undergarment to the waist part of the patient. To achieve the fixing means, the upper end 20 itself may be formed of an elastic material, or the elastic material may be added to the upper end

20. Alternatively, the upper end 20 may be sewn so as to form a specific space, and then an elastic material such as a rubber band may be inserted therein.

The front center sheets 110*a* and 110*b* and the back panel may be formed of the same material with each other. Unless the patient feel uncomfortable after being clothed with the undergarment, the material is not particularly limited if it is not harmful to the patient's skin. For example, a non-woven fabric such as a fabric currently widely being used or a SB fabric may be used. If necessary (for example, to differentiate between men's wear and women's wear), a variety of patterns may be printed on the fabric.

As shown in the drawing, the front center sheets 110*a* and 110*b* may be constructed such that the left side portion 110*a* and the right side portion 110*b* are joined with each other. For example, two sheets of fabric may be joined, with a seam line 41 being disposed therebetween. However, the present invention is not limited thereto. The front center sheets 110*a* and 110*b* may be formed by using a single fabric. In this case, the left side portion 110 and the right side portion 110 are exemplarily distinguished for clear understanding of the present embodiment.

An upper end width w2 of the front center sheets 110*a* and 110*b* may vary according to the size (e.g., small, medium, large, etc) of the disposable undergarment or whether it is men's wear or women's wear. The disposable undergarment has to be sized so as to sufficiently cover the groin part of the patient when in wear. In the case of further forming a pair of seam lines (to be described later), when the side portions of the front center sheets 110*a* and 110*b* are folded by a predetermined width w1 by means of the seam lines, the upper end width w2 has to be sized so as to cover the groin part of the patient in a folded state. For example, the side lines of the front center sheets 110*a* and 110*b* may be inwardly disposed in the range of ⅓ to ¾ width of a patient's thigh.

Each side edge of the front center sheets 110*a* and 110*b* may be further provided with a pair of seam lines 30*a* and 30*b* for folding the midpoint of the side portions by the predetermined width w1. The width w1 may be in the range of 2~8 cm, preferably, 3~5 cm. To facilitate folding by using the pair of seam lines 30*a* and 30*b*, the inner seam line 30*b* of the pair of seam lines 30*a* and 30*b* is preferably formed on the rear surface of the front center sheets 110*a* and 110*b* so that an end portion (outside with respect to the inner seam line 30*b*) of each side edge can be folded forward (the front surface direction if the plane of FIG. 3A). The outer seam line 30*a* is preferably formed on the front surface of the front center sheets 110*a* and 110*b* so that an end portion (outside with respect to the outer seam line 30*a*) of each side edge can be folded backward (the rear surface direction of the plane of FIG. 3A). The pair of seam lines 30*a* and 30*b* is provided so as to effectively expose the left and right thigh arteries near the groin part of the patient during medical treatment. Although the seam lines 30*a* and 30*b* are particularly described in the present embodiment, another appropriate means (e.g., a pair of concave and convex portions formed in a fabric itself) capable of achieving the same effect as mentioned above may be used.

As described above, the back panel includes the front side sheets 120*a* and 120*b* and the back sheets 130*a* and 130*b*. However, this is only an exemplary configuration of a finished disposable undergarment in order to facilitate explanation. That is, among the elements 120*a*, 120*b*, 130*a*, and 130*b* constituting the back panel, a portion constituting the front portion 100*a* of the disposable undergarment corresponds to the front side sheets 120*a* and 120*b*, and a portion constituting the back portion 100*b* of the disposable undergarment corresponds to the back sheets 130*a* and 130*b*. A line 61 which defines the front side sheets 120*a* and 120*b* and the back sheets 130*a* and 130*b* is shown only as an example. Thus, the line 61 may be a seam line for joining a pair of sheets. The front side sheets 120*a* and 120*b* may be respectively fabricated in one fabric along with the back sheets 130*a* and 130*b*, and the line 61 may be an imaginary line.

Each width w3 of the back sheets 130*a* and 130*b* is the same as that of the back portion 100*b* of the disposable undergarment. Thus, as described above, the width w3 is appropriately selected according to the size of the disposable undergarment or whether it is men's wear or women's wear. Each width w4 of the front side sheets 120*a* and 120*b* may half or more of a value obtained by subtracting the width w2 of the front center sheets 120*a* and 120*b* from the width w3 of the back sheets 130*a* and 130*b*. The reason of determining the width w4 of the front side sheets 120*a* and 120*b* is to allow the front side sheets 120*a* and 120*b* and the front center sheets 110*a* and 110*b* to overlap each other by a predetermined width (as shown in FIG. 3A). By being overlapping, the patient's skin can be prevented from being exposed and a margin is provided so as to install a pair of attaching means 10*a* and 10*b* in the front side sheets 120*a* and 120*b* and the front center sheets 110*a* and 110*b*. Further, the disposable undergarment according to the present embodiment provides pair of attaching means 10*a* and 10*b* locate at each of the both side edges of the front center sheet 110*a* and 110*b* and the side edge of the front side sheets 120*a* and 120*b*, respectively which is configured for detachably attach the front center sheet 110*a* and 110*b* to the front side sheets 120*a* and 120*b*. The pair of attaching means 10*a* and 10*b* can be attached to and detached from the front center sheets 110*a* and 110*b*, and a type thereof is not limited. For example, the pair of attaching means 10*a* and 10*b* may be a Velcro fastener, a magic tape currently widely used for diapers for baby, a zipper, or an attaching mechanism employing a button.

The number or position of the pair of attaching means 10*a* and 10*b* is not particularly limited. Preferably, by taking a function of the disposable undergarment into account, the attaching means 10*a* and 10*b* are respectively provided at the upper portion and the lower portion of the front center sheets 110*a* and 110*b* and the front side sheets 120*a* and 120*b*. One through three attaching means may be additionally provided between the upper portion and the lower portion.

Further, in the disposable undergarment according to an embodiment of the present invention, one edge portions of the assistant sheets 140*a* and 140*b* are attached to the front side edge portions of the front center sheets 110*a* and 110*b* in an overlap manner (see FIG. 3A). The assistant sheets 140*a* and 140*b* are not permanently attached thereto but attached with a strength suitable for being easily removed by the healthcare worker. This is because the assistance sheets 140*a* and 140*b* need to be easily removed from the front center sheets 110*a* and 110*b* after the angiography is completed. To this end, the assistant sheets 140*a* and 140*b* may be attached only to the upper and lower portions of the front center sheets 110*a* and 110*b* by means of a double-coated tape.

Adhesive means 142*a* and 142*b* are provided to one edge of the rear surfaces (the rear surface of the plane of FIG. 3A) of the assistant sheets 140*a* and 140*b*, that is, the other edges of the assistance sheets 140*a* and 140*b* not attached to the front center sheets 110*a* and 110*b*. The adhesive means 142*a* and 142*b* serve to attach the assistance sheets 140*a* and 140*b* to a patient's thigh for medical treatment.

The adhesive means 142*a* and 142*b* may be fabricated by using for example the double-coated tape. In this case, while a cover film over either one of the surfaces of the double-coated tape is not removed, the other surface thereof is attached to the assistant sheets 140*a* and 140*b*. This is done to prevent the adhesive means 142*a* and 142*b* from sticking to a portion of the disposable undergarment or the patient's skin when the patient is clothed with the disposable undergarment, and also to easily remove the cover film when the adhesive means 142*a* and 142*b* are attached to the patient's thigh. To achieve this, in the present embodiment, the cover film may be fabricated to be larger than the adhesive means 142*a* and 142*b*.

Preferably, the assistance sheets 140*a* and 140*b* are sufficiently sized so as to prevent antiseptic chemicals or blood flowing out during the medical treatment from permeating into the groin part of the patient when attached to the inner thigh of the patient, or to prevent the cut portion from infection due to pubic hairs or body fluids. For example, as shown in FIG. 3A, the height of the assistance sheets 140*a* and 140*b* are preferably lower than that of the front center sheet and higher than half of the height of the front center sheets 110*a* and 110*b*.

Moreover, the assistance sheets 140*a* and 140*b* are preferably not be absorbent with respect to blood flowing out during medical treatment or a variety of chemicals used for medical treatment. For example, the assistance sheets 140*a* and 140*b* may be formed of at least a waterproof material, or a material in which a waterproof film is coated thereon.

Now, a method of using the disposable undergarment according to the previously mentioned embodiment of the present invention will be described with reference to FIGS. 4A to 4D.

Figure 4A:
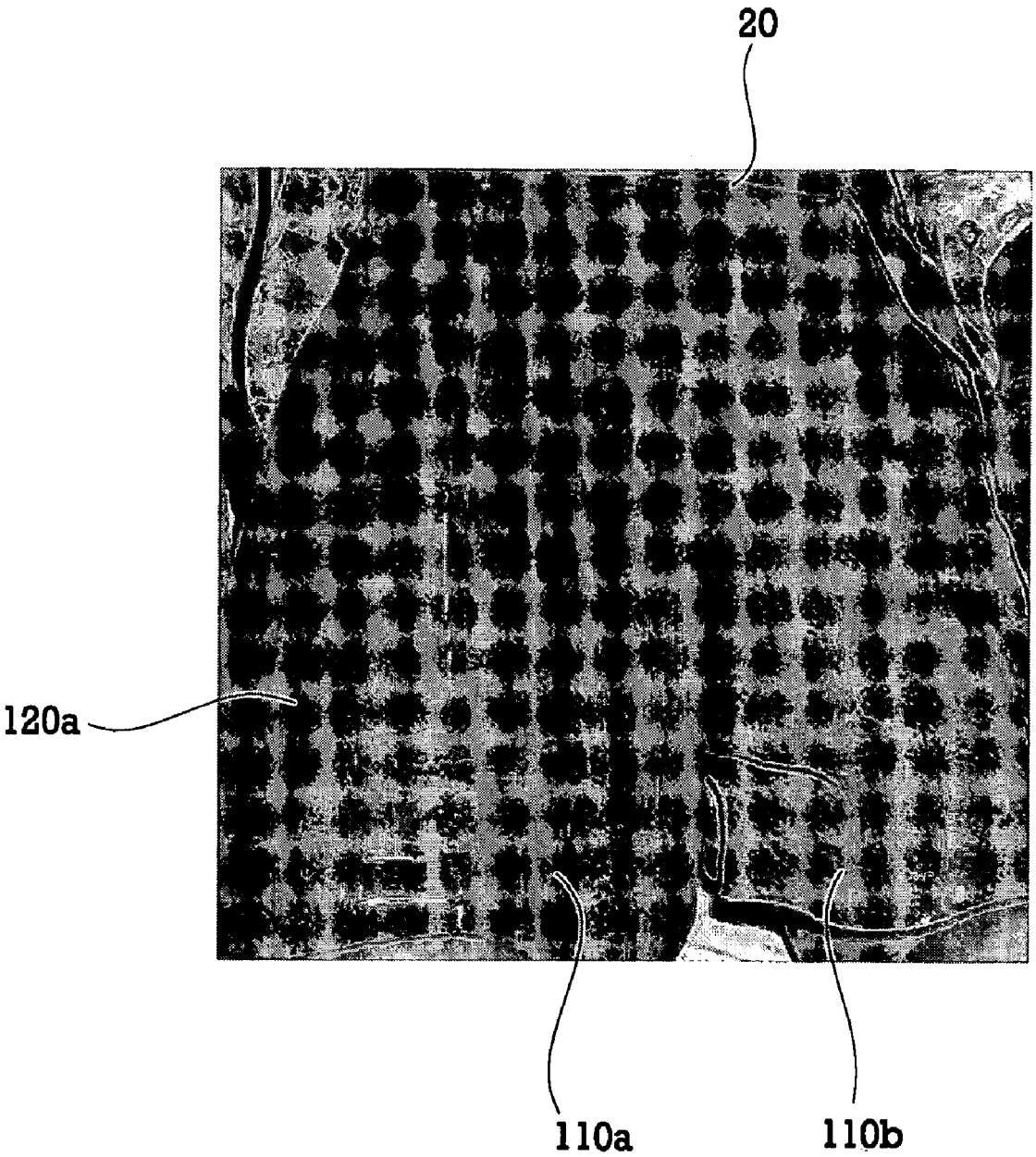
FIGS. 4A to 4D sequentially show a method of performing an angiography surgery by using a disposable undergarment for a medical treatment and surgery according to a first embodiment of the present invention.

Referring to FIG. 4A, the patient is clothed with the disposable undergarment prior to medical treatment. The disposable undergarment according to the present embodiment has a shape of a typical shorts or trunks, and the patient therefore can wear and take off it without other's help, resulting in maintaining dignity of the patient. Then, the patient lies down on a test bed or a surgical bed, and waits for the medical treatment.

Figure 4B:
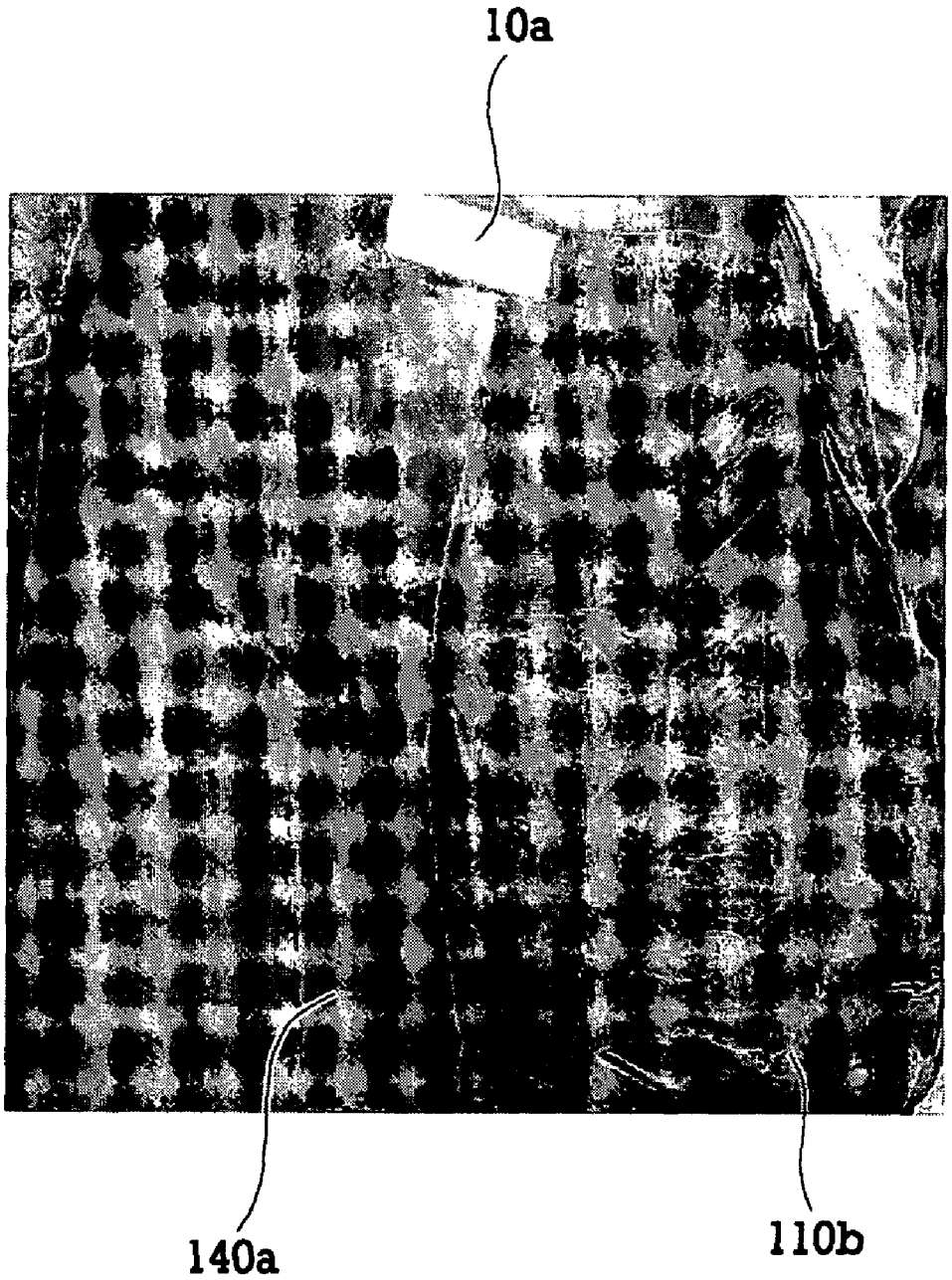

Referring to FIG. 4B, the healthcare worker prepares for the medical treatment. In this process, the left (or right) front side sheet 120*a* joined by means of the attaching means 10*a* and 10*b* is separated from the front center sheet 110*a*, and thereafter the front side sheet 120*a* is unfolded outwardly, thereby exposing a portion of the left thigh of the patient. Since the groin part of the patient remains covered by the front center sheet 110*a*, the patient's dignity can be maintained.

Next, the cover film of the adhesive means 142*a* in the rear surface of the assistance sheet 140*a* is removed, and an adhesive portion of the exposed adhesive means 142*a* is attached to an inner thigh of the patient. When the assistance sheet 140*a* is attached, a portion of a thigh artery indicated by a small circle in FIG. 4C has to be exposed. Further, when the pair of seam lines 30*a* and 30*b* are formed on the front center sheet 110*a*, the front center sheet 110*a* may be folded by a predetermined width w1 by using the seam lines 30*a* and 30*b* and then be attached before or at the same time when the adhesive means 142*a* is attached.

Figure 4C:
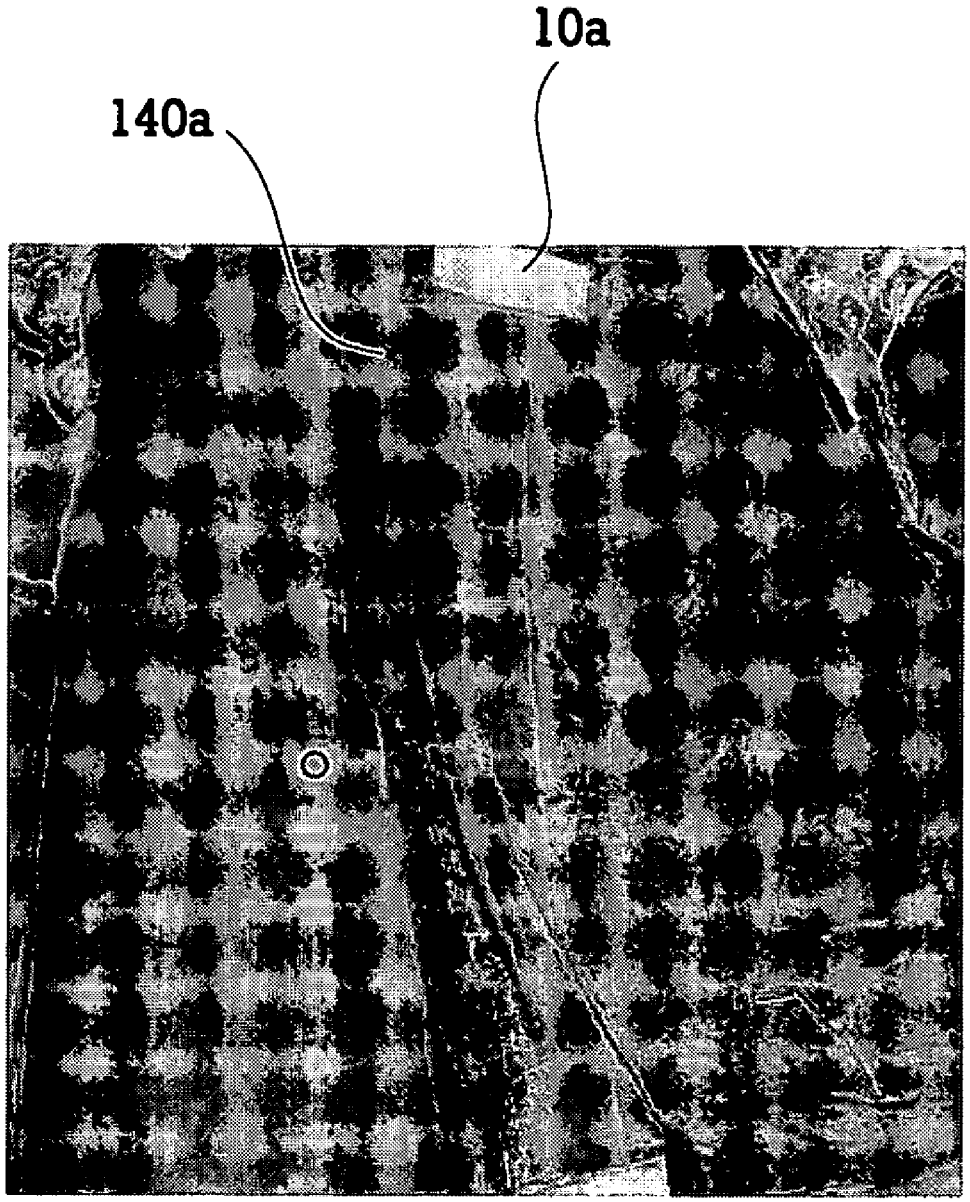

Next, a portion of thigh artery of the patient is cut in the state as shown in FIG. 4B, and a medical treatment required for the patient is carried out. Again, when the disposable undergarment according to the present embodiment is used, dignity of the patient can be maintained during medical treatment, and a cut portion can be prevented from infection. In addition, since the assistance sheet 140*a* is attached long in length along the inner thigh of the patient such that the lower portion thereof comes out of the patient's body, blood or surgical chemicals may be guided downward the assistance sheet 140*a*, so as to be effectively discharged. After the medical treatment is completed, the disposable undergarment is in the state as shown in FIG. 4C.

Figure 4D:
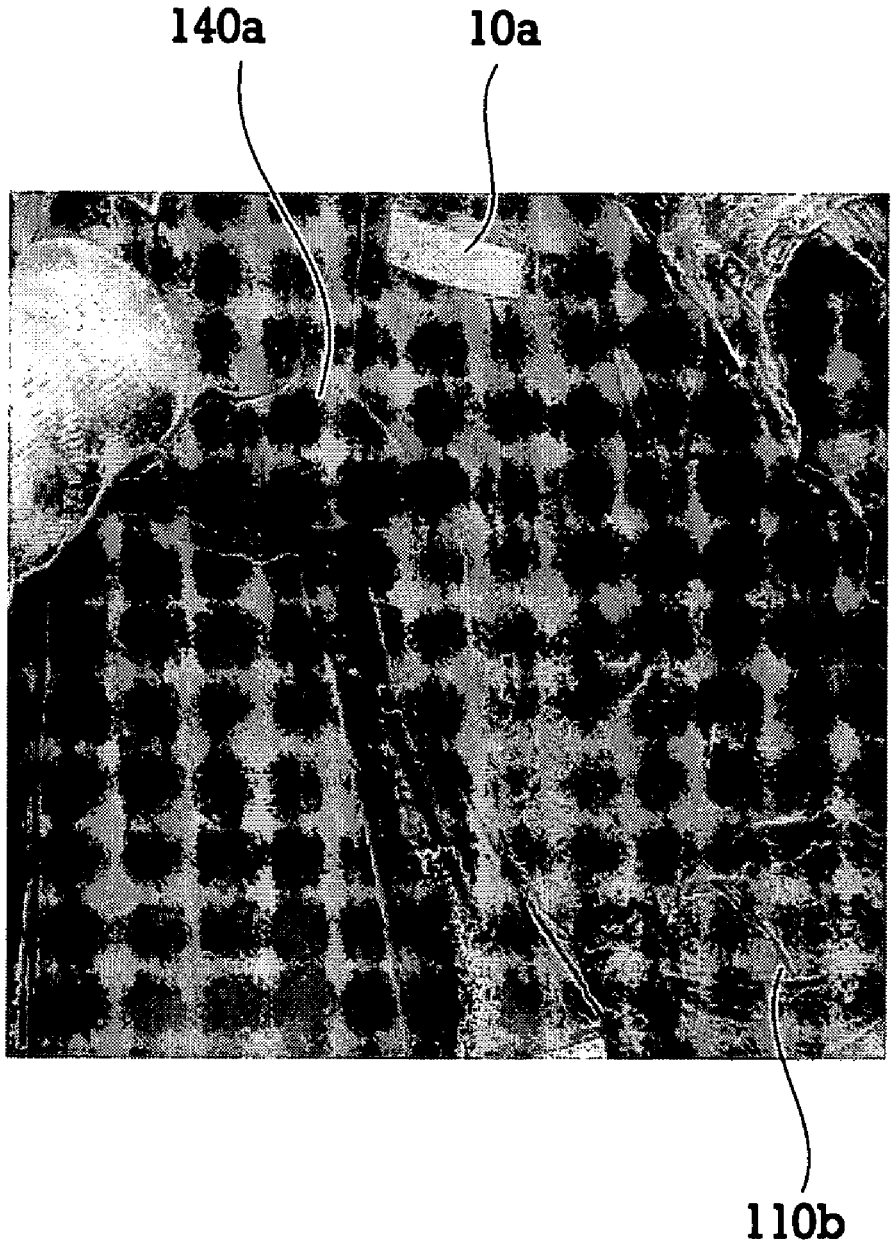

Next, referring to FIG. 4D, the assistance sheet 140*a* stained with blood and surgical chemicals is removed from the patient and the front center sheet 110*a*. As described above, since the assistance sheet 140*a* is attached to the patient and the front center sheet 110*a* by using the double-coated tape or the like, the healthcare worker can easily remove only the stained assistance sheet 140*a*. Finally, the front side sheet 120*a* unfolded outside the patient is folded and re-attached to the front center sheet 110*a* by using the attaching means 10*a* and 10*b*, so as to seemingly achieve the same state as shown in FIG. 4A. In this state, only stained assistance sheet 140*a* is removed in comparison with the state prior to the medical treatment. Accordingly, since a contaminant material is not stained in other portions of the disposable undergarment, not only dignity of the patient but also a secondary infection caused by the contaminant can be prevented.

Second Embodiment

Figure 5A:
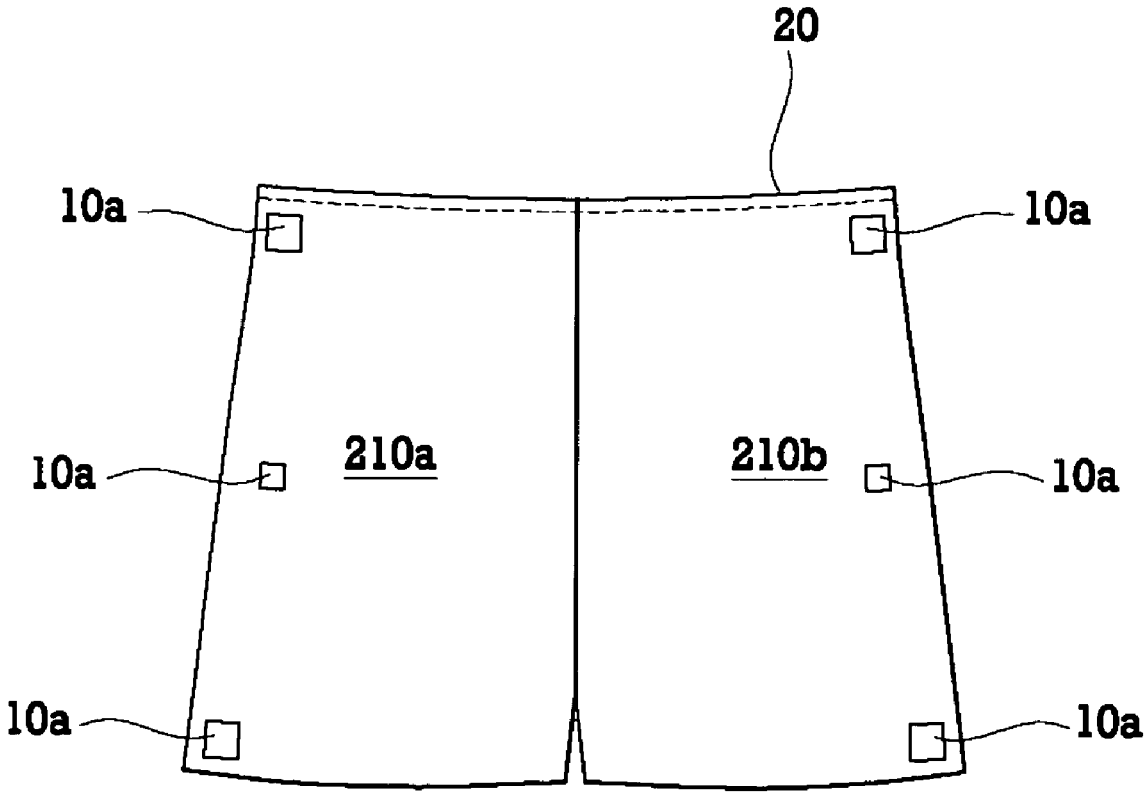
FIG. 5A is a front plan view of front center sheets of a disposable undergarment according to a second embodiment of the present invention.
Figure 5B:
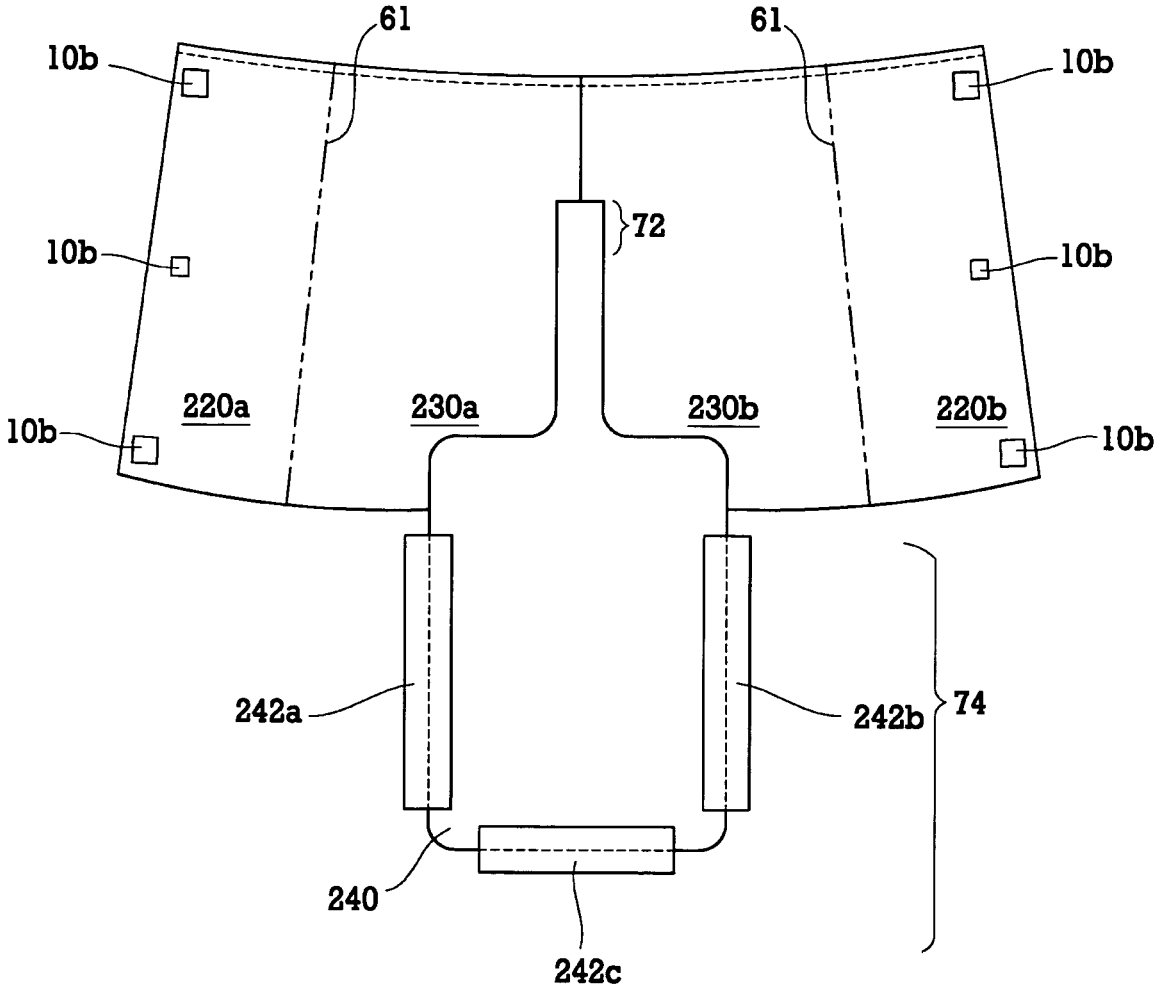
FIG. 5B is plan view showing an inner side of a back panel of a disposable undergarment according to a second embodiment of the present invention.

Front and rear views of a disposable undergarment for an angiography test, a medical treatment, and a surgery according to a second embodiment of the present invention are the same as shown in FIGS. 2A and 2B, except that the pair of seam lines 30*a* and 30*b* may be needed in the second embodiment. FIG. 5A is a front plan view schematically showing front center sheets 210*a* and 210*b* of a disposable undergarment according to a second embodiment of the present invention. FIG. 5B is plan view schematically showing a back panel of the disposable undergarment. And, FIG. 5C is a front plan view schematically showing inner surface of front center sheets 210*a*' and 210*b*' of a disposable undergarment according to another aspect of the second embodiment of the present invention.

The disposable undergarment according to the second embodiment is also generally formed in the shape of a boxer shorts, a short pants, or a trunks. Further, the disposable undergarment includes front center sheets 210*a* and 210*b*, the back panel, assistance sheets 240, and a pair of attaching means 10*a* and 10*b*. The front center sheets 210*a* and 210*b*, the back panel, the attaching means 10*a* and 10*b* have the same function, structure, size, and material as those of the disposable undergarment according to the first embodiment of the present invention. In addition, the assistance sheets 240 have the same function and material as those of the disposable undergarment according to the first embodiment of the present invention. Hereinafter, therefore, only a distinctive feature with respect to the first embodiment will be described in brief.

Figure 5C:
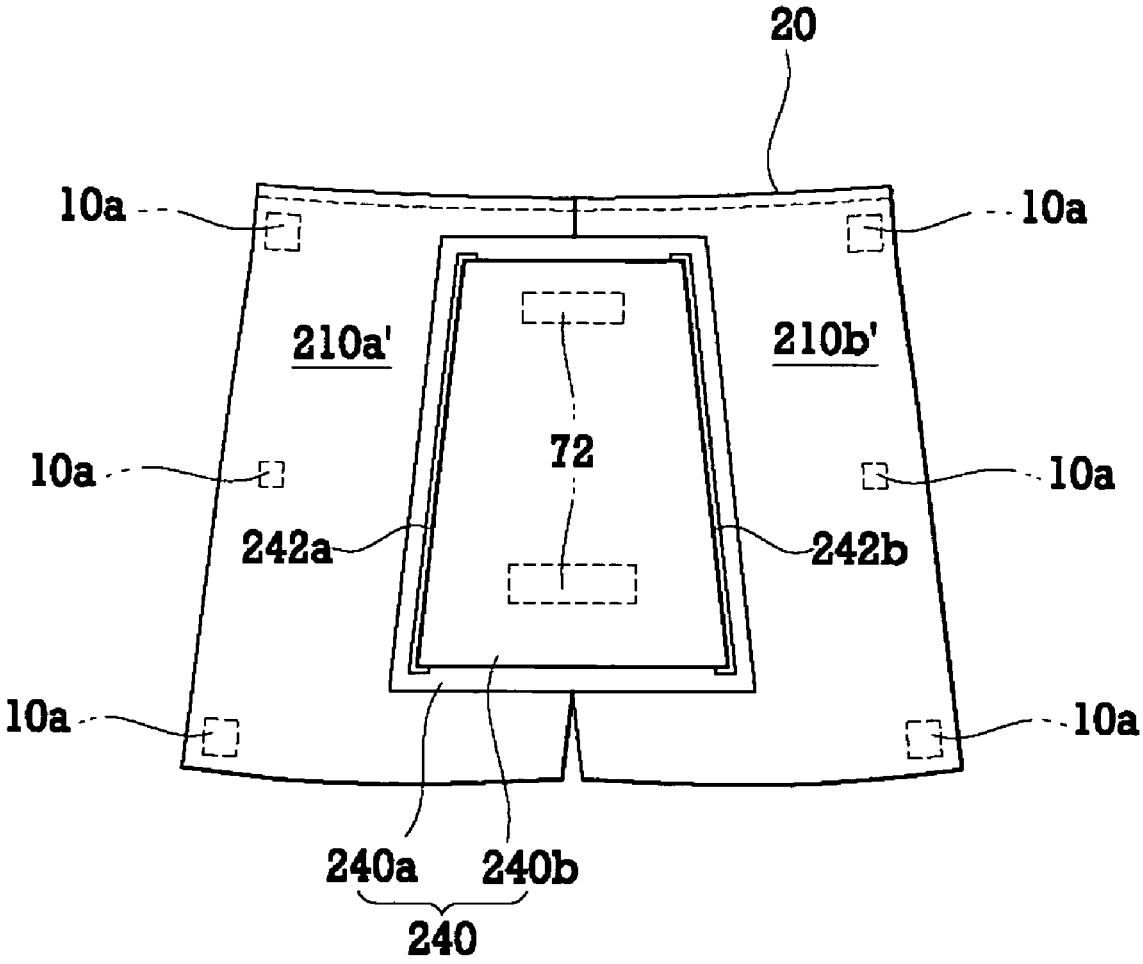
FIG. 5C is a plan view of inner surface of front center sheets of a disposable undergarment according to another aspect of the second embodiment of the present invention.

Referring to FIGS. 5A, 5B, and 5C, a assistance sheet 240 according to the second embodiment is different from the assistance sheets 140*a* and 140*b* according to the first embodiment in terms of an attaching position and a shape and a number of sheets thereof. As shown in FIG. 5C, the assistance sheets 240 may comprise an inner sheet 240*b* and an outer cover sheet 240*a* which is bigger than the inner sheet 240*b*. However, as in the first embodiment, the function and material of the assistance sheet 240 are the same as describe above in a sense that the assistance sheet 240 is removed from the disposable undergarment after medical treatment.

The assistance sheet 240 is disposed such that one end thereof, that is, a fixing portion 72, is attached to a center portion of the back sheets 230*a* and 230*b*, but the present invention is not limited thereto. For example, the assistnace sheet 240*a* may be attached to the inner surface of the front sheets 210*a*' and 210*b*' as shown in FIG. 5C using a fixing portion 72. In this case, the fixing portion 72 in FIG. 5B which is attached to a center portion of the back sheets 230*a* and 230*b* is unnecessary. The position of the fixing portion 72 may vary depending on the shape of an assistance sheet 240 or the position where an assistance sheet 240 is attached to. The fixing portion 72 is not particularly limited to its attaching manner. For example, it may be fastened by means of sawing, or by using the double-coated tape or the like. However, since the assistance sheet 240 has to be separated from the back sheets 230*a* and 230*b* after medical treatment, it is preferable that the fixing portion 72 is attached so as to easily remove the assistance sheet 240.

The assistance sheet 240 covers the groin part of the patient, and prevents a cut portion of thigh artery from infection during medical treatment. Further the assistance sheet 240 prevents blood or surgery chemicals from smearing toward the groin part of the patient during medical treatment. To achieve the aforementioned advantage, the protector 74 requires to have a specific width and height. A detailed size thereof may be appropriately determined. The shape of the protector 74 is not particularly limited. For example, the protector 74 may have a shape of square, ellipse, or circle as shown in the drawing. The protector 74 has to be sized enough to cover the groin part (genitalia) of the patient, with the thigh artery being uncovered. For example, when the protector 74 is square-shaped, it may have a size about 10~15 cm in width, and 15~25 cm in length.

Preferably, the protector 74 in FIG. 5B or the assistance sheet 240*a* in FIG. 5C is temporarily fixed to the front center sheets 210*a* and 210*b* when in wear. That is, the assistance sheet 240 is connected via the crotch of the disposable undergarment from the back sheets 230*a* and 230*b*, and is temporarily fixed to the front center sheets 210*a* and 210*b*. Further, the assistance sheet 240 may be constructed so that the healthcare worker can detach the assistance sheet 240 from the front center sheets 210*a* and 210*b* so as to fix to the patient when preparing for medical treatment. To this end, in the rear surface edge of the protector 74, the protector 74 and the front center sheets 210*a* and 210*b* may be connected with each other by using the double-coated tape or the like.

The protector 74 needs to be attached to the patient for medical treatment such as angiography. To achieve this, the protector 74 has to be first separated from the front center sheets 210*a* and 210*b*. This process is carried out before the healthcare worker starts medical treatment. The front surface of the protector 74 is provided with adhesive means 242*a*, 242*b*, and 242*c*, and the upper portion thereof is attached with a cover film. As shown in FIG. 5B, the adhesive means 242*a*, 242*b*, and 242*c* are disposed to an upper edge 242*c* and both side edges 242*a* and 242*b*. As shown in the drawing, the adhesive means 242*a*, 242*b*, and 242*c* may be attached such that some portions thereof overlap the protector 74, or may be located inside the protector 74. The protector 74 is attached to the groin part of the patient by using the adhesive means 242*a*, 242*b*, and 242*c* after the cover film is removed from its upper portion The disposable undergarment according to the second embodiment of the invention may not preserve the patient's dignity to some extent when the protector 74 of the assistance sheet 240 is attached. However, since the stained assistance sheet 240 can be removed from the disposable undergarment after medical treatment, the patient may not feel inconvenience or discomfort after medical treatment. Further, a secondary infection caused by the stained assistance sheet 240 may be prevented.

The disposable undergarment according to the first and second embodiments of the present invention can apply to not only a surgery using angiography but also a surgery performed while the patient is unclothed with a general undergarment (underwear). When a general surgery is performed without having to use angiography, the assistance sheets 140 and 240 may be removed if not required. According to the second embodiment of the present invention, the assistance sheets 140 and 240 are removably fixed by means of the double-coated tape or the like, and thus the assistance sheets 140 and 240 can be easily removed if required. Therefore, when the patient is clothed with the disposable undergarment of which the assistance sheets 140 and 240 are removed, dignity of the patient can be maintained during a general surgery. Further, if blood or medical chemicals stain the disposable undergarment, the patient does not suffer from economic burden to discard it.

Third Embodiment

Figure 6A:
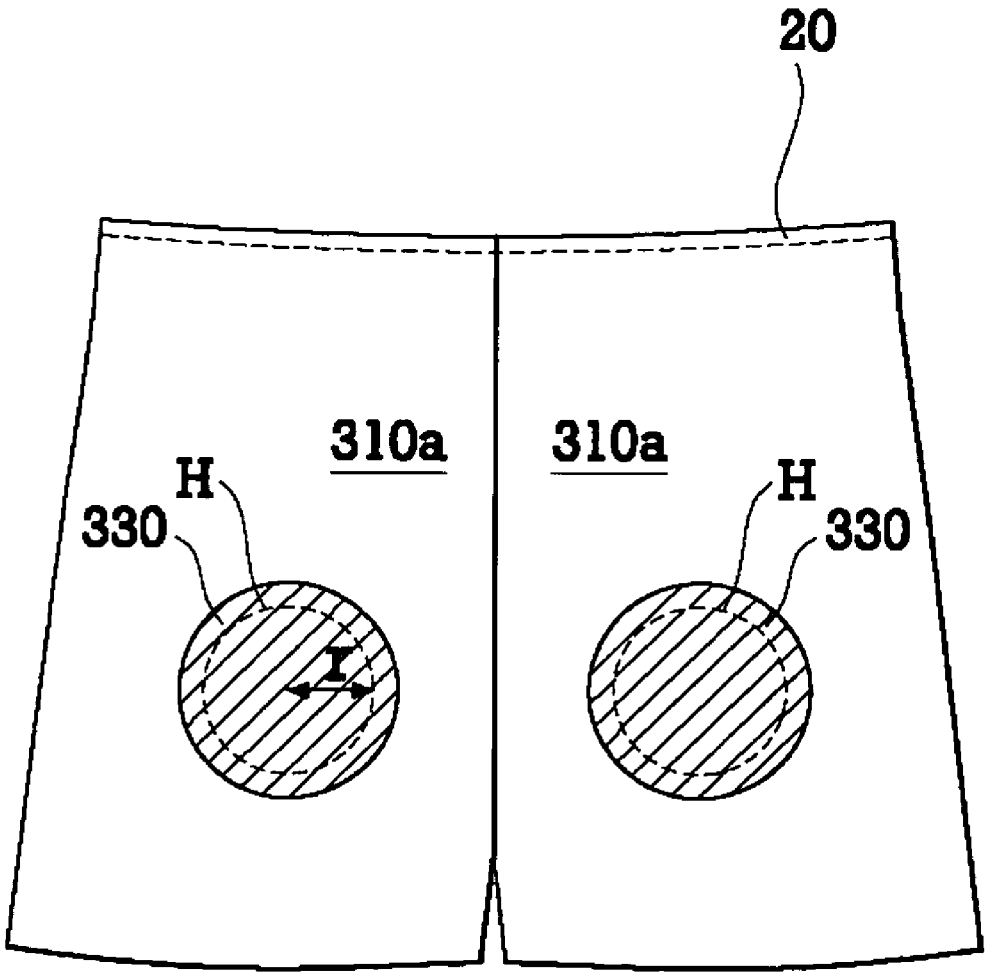
FIGS. 6A, 6B, and 6C show a front view and a rear view of a disposable undergarment for a medical treatment and surgery, and a plan view of an inner surface of a front sheet thereof, respectively, according to a third embodiment of the present invention.
Figure 6B:
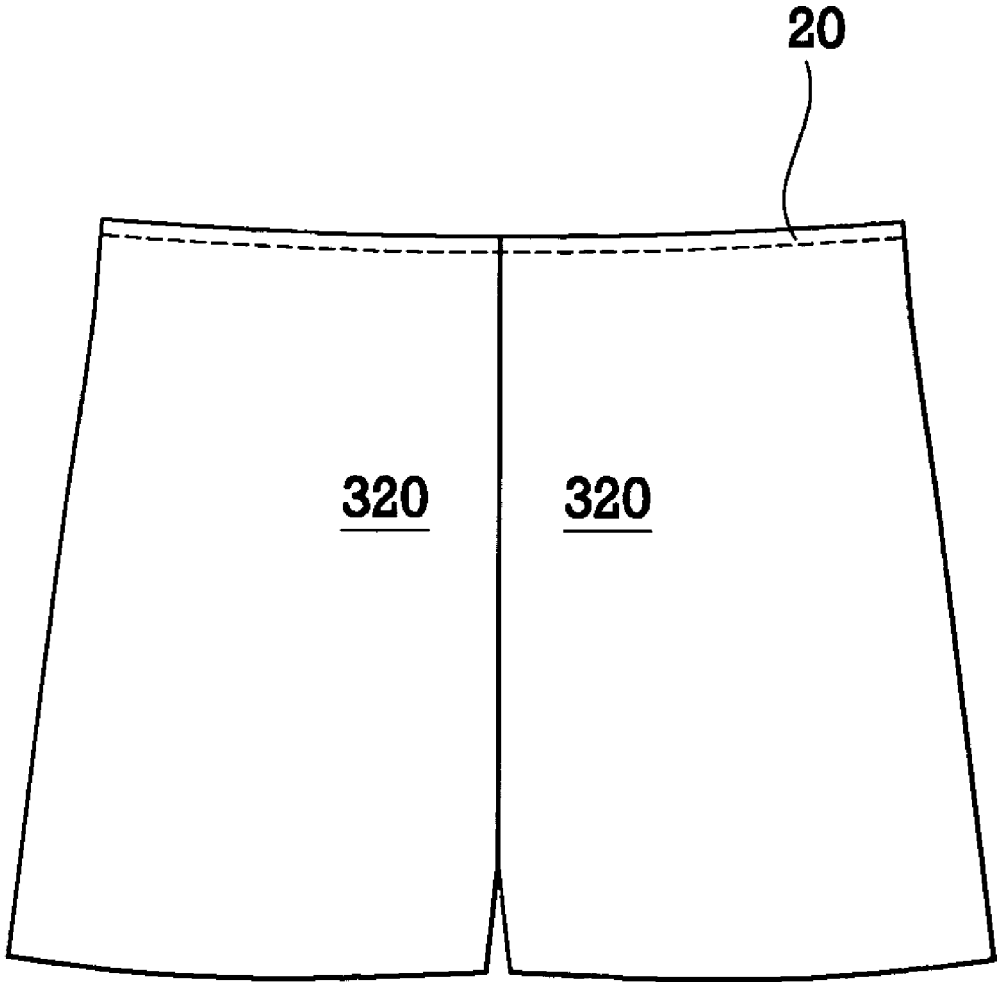
Figure 6C:
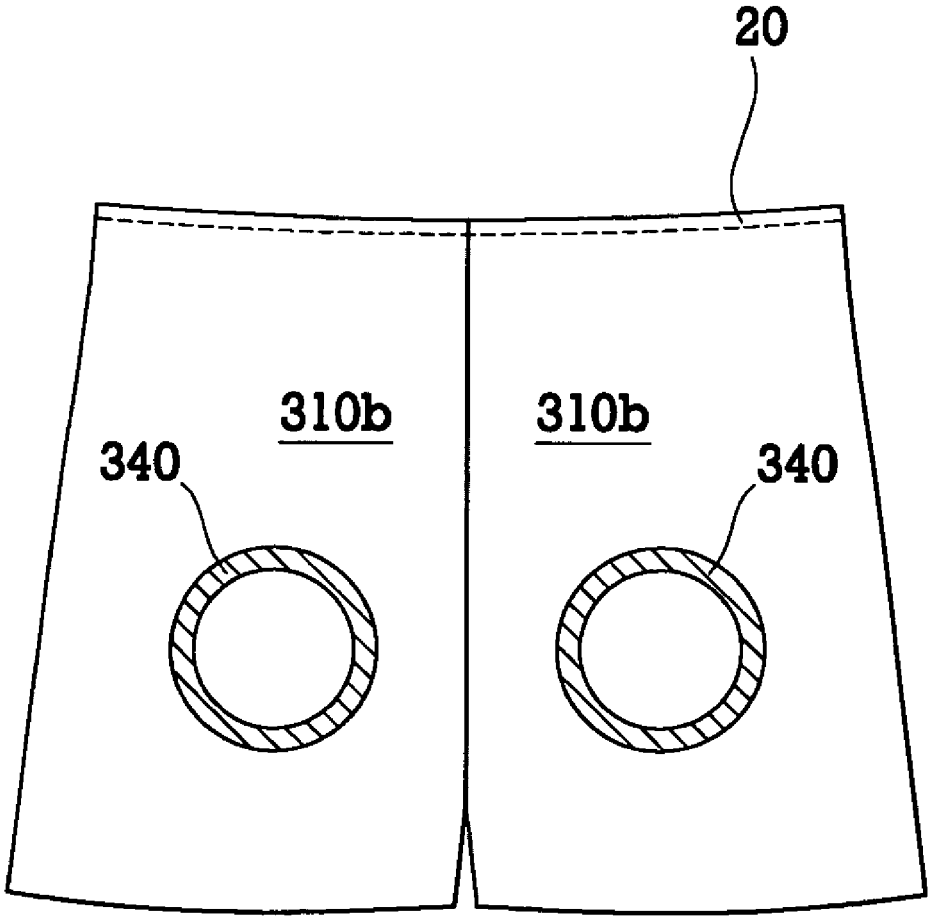

FIGS. 6A, 6B, and 6C show a front view and a rear view of a disposable undergarment for an angiography test, a medical treatment, and a surgery, and a plan view of an inner surface of a front sheet, respectively, according to a third embodiment of the present invention. Now, a disposable undergarment according to the third embodiment of the present invention will be described focusing on a difference from the first and second embodiments.

Referring to FIGS. 6A, 6B, and 6C, the disposable undergarment according to the third embodiment is also generally formed in the shape of a boxer shorts, a short pants, or a trunks. Further, the disposable undergarment includes front sheets 310*a* and 310*b*, a back sheet 320, and a covering sheet 330. The front sheets 310*a* and 310*b* are integrally joined with each other, thereby forming a basic shape of the disposable undergarment. The front sheets 310*a* and 310*b* and the back sheet 320 may be separately fabricated with one fabric in an integral manner, or may be joined with each other to be formed with two or more fabric by means of sawing or the like. Moreover, the front sheets 310*a* and 310*b* and the back sheet 320 may be integrally fabricated with one fabric, or may be joined with each other by means of sawing or the like.

In the disposable undergarment according to the present embodiment, as shown in FIGS. 6A and 6C, a pair of holes H are formed at the left and right sides of the front sheets 310*a* and 310*b*. A hole H is formed at positions associated with a thigh artery when the patient is clothed with the disposable undergarment. Further, the hole H may have a shape of square, ellipse, or circle, and has a specific size so that the thigh artery of the patient or a certain portion of its vicinity can be exposed through the hole H. For example, the diameter of a circular shaped hole H, the short-axis length of an elliptical hole H, and the short-side of a square hole H may be approximately 5 to 10 cm.

In addition, as shown in FIG. 6A, the covering sheet 330 covering the hole H is removably or attachable/detachably provided to a front surface 310*a* of the front sheets 310*a* and 310*b*. If the covering sheet 330 is removably provided, once the covering sheet 330 is removed for medical treatment, the covering sheet 330 is not re-attached to the front surface 310*a* of the front sheets 310*a* and 310*b* after surgery is completed. On the other hand, if the covering sheet 330 is attachable/detachably provided, the covering sheet 330 is re-attached to the front surface 310*a* of the front sheets 310*a* and 310*b* after medical treatment is completed.

Preferably, the size of the covering sheet 330 is equal to or greater than that of the hole H so that the patient's skin can be prevented from being exposed when the patient is clothed with the disposable undergarment. Further, the covering sheet 330 is preferably fabricated by using the same fabric as those of the front sheets 310*a* and 310*b* and the back sheet 320 in terms of external look. The covering sheet 330 may be fabricated by using another fabric or synthetic resin such as vinyl, paper type, or a polyamide film.

As shown in FIG. 6C, an adhesive means 340 is provided around the hole H of a rear surface 310*b* of the front sheets 310*a* and 310*b*. The adhesive means 340 serves to attach the rear surface 310*b* of the front sheets 310*a* and 310*b* to the patient's skin during medical treatment. Since the front sheets 310*a* and 310*b* are not fixed without the presence of the adhesive means 340, medical treatment may be hindered. If the rear surface 310*b* of the front sheets 310*a* and 310*b* is attached to the patient's skin prior to medical treatment, it is not easily attached to a correct position, and also causes discomfort to the patient. Thus, a cover film (not shown) capable of preventing adhesion may not be formed on the upper surface of the adhesive means 340. In this case, the cover film may be directly removed by the healthcare worker. Alternatively, the adhesive means 340 may be constructed so that it can remove the cover film from the rear surface 310*a* of the front sheets 310*a* and 310*b*, or to remove the cover film directly from the front surface 310*b* of the front sheets 310*a* and 310*b*.

Although not shown, an assistance sheet may be further provided around the hole H on the front surface 310*a* of the front sheets 310*a* and 310*b* of the disposable undergarment according to the present embodiment. Similarly to the aforementioned first or second embodiment, the assistance sheet serves to prevent blood or medical chemicals from staining the disposable undergarment or the patient's skin during medical treatment. The assistance sheet may be attached to the front surface 310*a* of the front sheets 310*a* and 310*b* around the hole H in a ring shape having a specific width.

The disposable undergarment according to the third embodiment of the present invention is different from the aforementioned first and second embodiments in that front sheets are integrally formed, and an attaching means is not provided at the both sides thereof. However, the same effect can be expected in that the patient's dignity can be maintained in an aspect that the patient can wear the undergarment without other's help since it is a trunk-shaped disposable undergarment. Moreover, in the third embodiment, since the front sheets are fixed while only a portion required for medical treatment being exposed, and other portions are being covered, it may be further effective in terms of protecting the patient's dignity.

Accordingly, when an angiography test, an interventional medical treatment, or an angiography surgery is performed by using angiography, a patient can be protected from being infected by germs through a cut portion since the groin part of the patient can be entirely covered by an assistance sheet of a disposable undergarment. In the disposable undergarment according to the first embodiment of the present invention, the groin part of the patient is not exposed at all, and thus discomfort of the patient can be minimized while the patient's dignity is maintained as much as possible.

In addition, since a stained assistance sheet can be entirely removed from the disposable undergarment after medical treatment such as the angiography test is completed, a secondary infection caused by the stained disposable undergarment can be prevented, and also inconvenience or discomfort can be minimized.

In addition, the disposable undergarment has an advantage in that it can be used irrespective of the position of a thigh artery or a physical feature of the patient if only a few sizes are prepared. For example, whether it is men's wear or women's wear, and whether it is a small size, a medium size, and/or a large size are prepared.

Moreover, when medical treatment for either one side of thigh arteries is not smoothly performed, and thus the medical treatment is performed with respect to the other side of thigh arteries, the medical treatment can be carried out with a simple preparation without losing the patient's dignity, thereby providing significant convenience for a surgical practitioner.

What is claimed is:

1. A disposable undergarment for an angiography, intervention or a surgery, comprising:

a front center sheet;

a back panel including a pair of front side sheets and a back sheet integrated with the pair of front side sheets, wherein the width of the back panel is three times larger than that of the front center sheet;

a pair of attaching means disposed at each side portion of the front center sheet and at each side portion of the front side sheet of the back panel, respectively, wherein the attaching means is dimensioned and configured to detachably attach the front center sheet overlapping with the front side sheet of the back panel; and a pair of assistance sheets configured to detachably attach at the front center sheet to make of the assistance sheets overlap with the front center sheet, wherein one end portion of the assistance sheets is provided with an attaching means to support detachably attaching to the front center sheet to prevent chemicals and blood from permeating into groin part of a patient and the other end portion of the assistance sheets includes an adhesive means to support detachably attaching assistance sheets to a thigh portion of the patient to prevent cut portion from infection, wherein the length and width of the front center sheet is predetermined selectively to cover the groin part of a patient and selectively to expose the left and right thigh arteries near the groin part, wherein a pair of seam lines is vertically formed based on the predetermined width and length of the front center sheet at each side of the front center sheet to facilitate selectively covering and exposing, wherein the front center sheet is dimensioned and configured to be folded by a predetermined width, wherein the side portions of the front center sheet are configured to be selectively detached from the side portions of the front side sheets of the back panel during the angiography, intervention, or surgery, and the assistance sheets are configured to be separately disposed of after the angiography, intervention, or surgery.

2. A disposable undergarment according to claim 1, wherein the assistance sheets are formed of waterproof material and durable against surgical chemicals.

3. A disposable undergarment according to claim 1, wherein the adhesive means include an adhesive tape having a removable cover film on its upper surface.

4. A disposable undergarment according to claim 1, wherein an inner seam line of the pair of seam lines is formed at rear surface of the front center sheet, and an outer seam line of the pair of seam lines is formed at front surface of the front center sheet.

5. A disposable undergarment according to claim 1, wherein the height of the assistance sheets are lower than that of the front center sheet and higher than half of the height of the front center sheets.

* * * * *